United States Patent [19]

Buchanan

[11] Patent Number: 4,586,910

[45] Date of Patent: May 6, 1986

[54] INFLATION VALVE FOR BALLOONS AND THE LIKE

[75] Inventor: Bradley Buchanan, San Francisco, Calif.

[73] Assignee: M&D Balloons, Brisbane, Calif.

[21] Appl. No.: 645,594

[22] Filed: Sep. 17, 1984

[51] Int. Cl.[4] ..... A63H 3/06; A63H 33/00; F16K 15/20

[52] U.S. Cl. ..... 446/220; 137/223; 137/533; 137/533.23; 251/333; 446/224

[58] Field of Search ..... 446/220, 221, 223, 224, 446/225, 226; 251/333; 137/223, 533, 533.11, 533.21, 533.23

[56] References Cited

U.S. PATENT DOCUMENTS

| | | | |
|---|---|---|---|
| 362,678 | 5/1887 | Sutton | 137/533 |
| 1,136,932 | 4/1915 | Brucker | 446/224 |
| 1,905,361 | 4/1933 | Bacon | 137/223 X |
| 2,701,579 | 2/1955 | Hasselquist | 137/223 |
| 2,752,941 | 7/1956 | Mitchell | 251/333 |
| 2,792,669 | 5/1957 | Jackson et al. | 446/224 |
| 2,924,041 | 2/1960 | Jackson et al. | 446/224 |
| 3,536,906 | 10/1970 | Bloom | 446/220 |
| 3,598,145 | 8/1971 | Wolfson | 137/533.21 |
| 4,077,158 | 3/1978 | Hurst | 446/226 X |

*Primary Examiner*—F. Barry Shay

*Attorney, Agent, or Firm*—Phillips, Moore, Lempio & Finley

[57] ABSTRACT

A toy balloon has an inflation valve secured thereon to selectively fill a chamber of the balloon with a fluid, such as helium. The valve comprises a stem defining a filling passage therethrough for communicating a pressurized fluid source with the inflatable chamber of the balloon and an elastomeric plug reciprocally mounted in the passage for movement in a first direction towards the chamber to openly communicate the passage with the chamber to permit filling thereof and for further movement in a second, opposite direction away from the chamber to seal the passage to prevent escape of the fluid from the balloon. The inner surface of the stem and/or the outer surface of the elastomeric plug may be suitably sized and tapered to permit the sleeve to compress the plug for sealing purposes when it is moved in its second closing direction. An annular bead may be formed internally on the sleeve to compress the plug to form an annular static seal between the sleeve and the plug.

15 Claims, 7 Drawing Figures

FIGURE 1
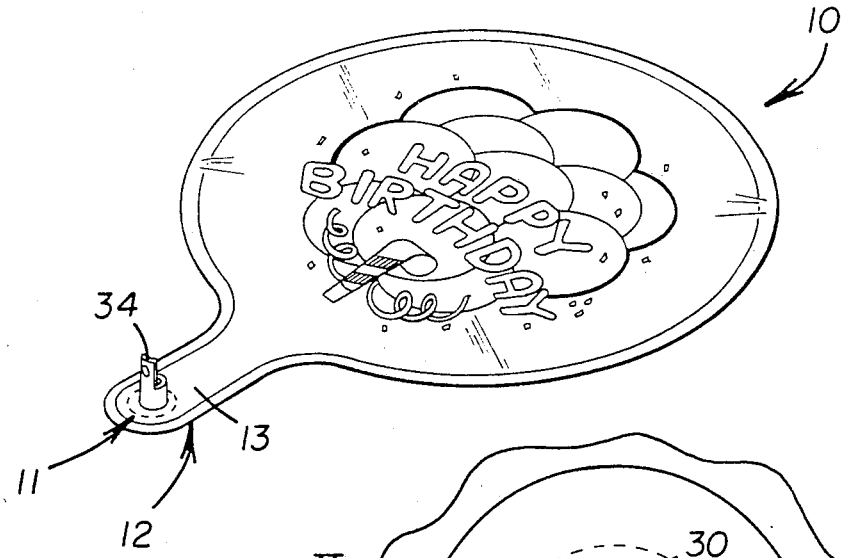
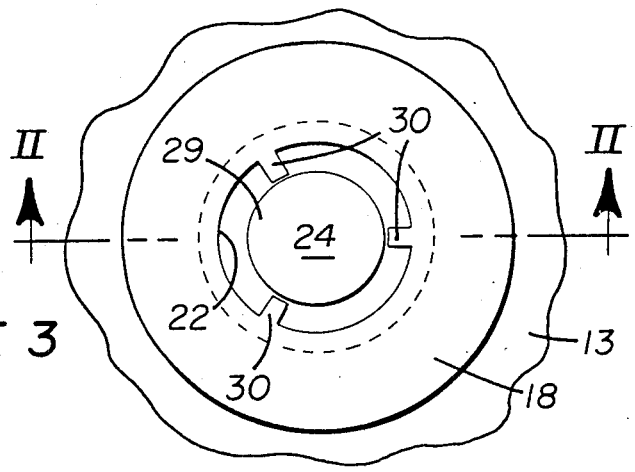
FIGURE 3
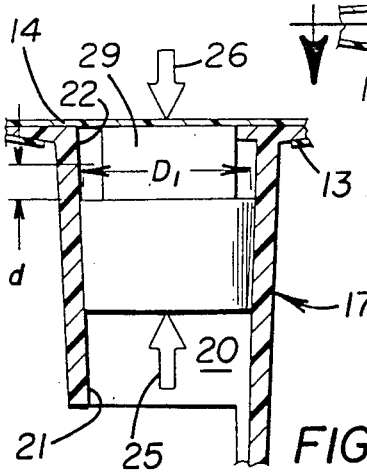
FIGURE 4
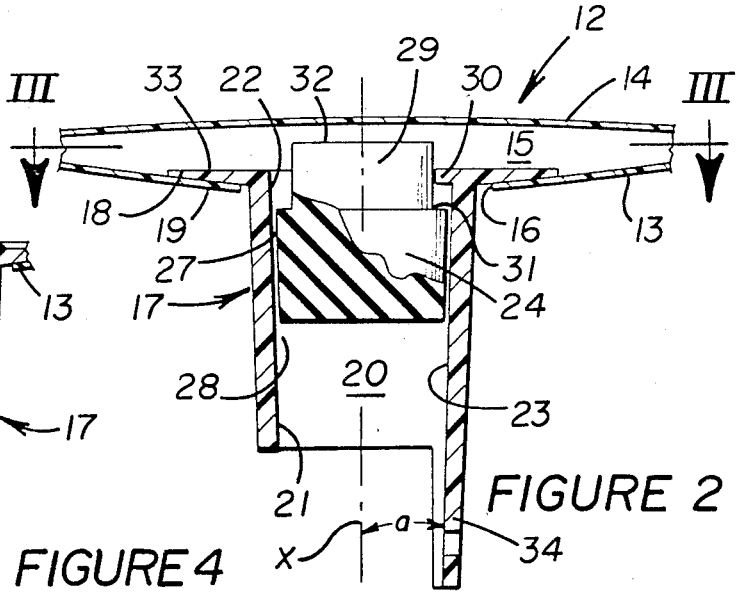
FIGURE 2

INFLATION VALVE FOR BALLOONS AND THE LIKE

DESCRIPTION

1. Technical Field

This invention relates generally to a one-way valve and more particularly to an inflation valve for inflating a toy balloon with an inert gas.

BACKGROUND ART

A recurring problem with metalized and rubber toy balloons is one of providing such balloons with an inflation valve adapted to expeditiously fill the balloon with an inert gas and to provide an efficient static seal when the valve is closed. In addition, it is desirable that the valve be constructed to open easily for refilling purposes. Another problem encountered with conventional valves of this type is that the wide variety of filling devices therefor normally require a specially constructed valve for adaptation to a particular filling device.

Conventional valves are also prone to dislodgement after the balloon has been filled and the valve closed. The primary reason underlying the latter problem is that the conventional valve stem is normally pushed inwardly towards the outlet of the valve and the filling chamber of the balloon for closing purposes. For example, U.S. Pat. No. 3,905,387 discloses a valve of this type wherein an elastomeric, tapered plug is pushed inwardly for valve closing purposes.

DISCLOSURE OF INVENTION

An object of this invention is to provide an efficient and highly dependable valve adapted to selectively inflate balloons and the like. The valve is further adapted to be opened for refilling purposes and closed in a protected position on the balloon to avoid inadvertent opening thereof.

In one aspect of this invention, a balloon has an inflatable chamber defined therein and an inflation valve secured thereon for selectively filling the chamber with a fluid, preferably an inert gas. The valve comprises a stem defining a filling passage therein communicating with the chamber and a plug reciprocally mounted in the passage for movement in a first direction towards the chamber and in a second, opposite direction away from the chamber. When the plug is moved in its first direction, it will openly communicate the passage with the chamber for filling purposes and when it is moved in its second direction it will seal the passage to prevent the fluid from escaping from the chamber. As suggested above, the directions of movement of the plug means for the purpose of opening or closing the inflation passage are opposite to the directions of movement of the above-discussed conventional types of inflation valves.

Although the inflation valve of this invention is particularly adapted for filling balloons and the like, it should be understood that the valve has other filling applications well-known to those skilled in the arts relating hereto.

BRIEF DESCRIPTION OF THE DRAWINGS

Other objects and advantages of this invention will become apparent from the following description and accompanying drawings wherein:

FIG. 1 illustrates a standard metalized balloon having an inflation valve embodiment of this invention secured thereon;

FIG. 2 is an enlarged cross-sectional view through the inflation valve, generally taken in a direction of arrows II—II in FIG. 3, showing the valve in an intermediate, open position;

FIG. 3 is a plan view of the inflation valve, taken in a direction of arrows III—III in FIG. 2;

FIG. 4 is a view similar to FIG. 2, but showing the inflation valve in its closed position;

BEST MODE OF CARRYING OUT THE INVENTION

Figure 5:
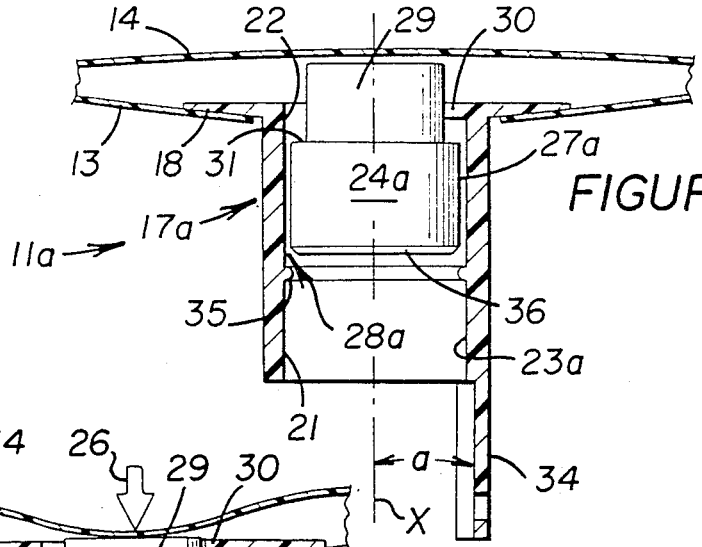
FIGS. 5 and 6 are cross-sectional views, similar to FIGS. 2 and 4, respectively, but illustrate a second inflation valve embodiment of this invention.

FIG. 1 illustrates a metalized balloon 10 having an inflation valve 11 secured on a stem 12 thereof. The balloon may comprise a pair of superimposed and heat-sealed panels each composed of a composite laminate, such as an exterior layer of aluminum, an intermediate layer of a suitable plastic and an inner layer of a heat-sealable coating, such as polyethelene. Composite laminates of this type are well known in the art, as exemplified by those disclosed in U.S. Pat. No. 4,077,588.

Referring to FIGS. 2–4, stem 12 and remaining portions of the balloon comprise first and second walls or panels 13 and 14, respectively, defining a closed and sealed filling chamber 15 of the balloon therebetween. The superimposed panels are heat-sealed entirely about the periphery of the balloon, including stem 12, to form a continuous and airtight seal therearound. In particular, inner surfaces of the panels are coated with a heat sensitive material, such as polyethylene, that will reactivate (melt) at temperatures approximating 300° F. The sole opening to chamber 15 constitutes an opening 16, formed through wall 13 of stem 12 and having valve 11 secured thereover.

As further shown in FIG. 2, valve 11 comprises a tubular stem 17 terminating at its inner end at an annular flange 18, extending radially outwardly from the stem. The stem and flange may be composed of a standard semi-rigid polyethylene material. An inner surface 19 of the flange is heat-sealed to the polyethelene coating on the inner side of wall 13 prior to the heat sealing of panels 12 and 13 together about their peripheries.

A generally cylindrical filling passage 20 is defined through stem 17 and has an inlet 21 adapted to receive a filling nozzle of a source of pressurized fluid, such as helium gas. The inlet communicates such fluid to a segmented outlet 22 of the passage for freely passing the pressurized fluid into filling chamber 15 of the balloon. In this embodiment of the invention, a frusto-conical inner wall 23 of stem 17 is preferably tapered to converge outwardly from outlet 22 to inlet 21 at an angle "a" within the approximate range from 2° to 10° relative to a longitudinal and central axis X of the sleeve, when viewed in cross-section.

A valve member in the form of an elastomeric and generally cylindrical plug 24 is reciprocally mounted in passage 20 for movement in a first direction 25 (FIG. 4) towards outlet 22 and chamber 15 and in a second, opposite direction 26 towards inlet 21. As described more fully hereinafter, when the plug is moved in its first direction 25, inlet 21 will openly communicate with outlet 22 to permit chamber 15 to be filled with a fluid, such as a pressurized helium gas, for balloon inflation purposes. Conversely, movement of the plug in its second or closing direction 26 will function to seal passage 20 to prevent escape of fluid from chamber 15 by creating an annular static seal between an outer surface 27 of the plug and inner wall 23 of sleeve 17.

Outer surface 27 of the plug is also preferably frustoconical and has a taper within the above range of angles "a" and may exhibit a taper corresponding to the taper of inner wall 23 of stem 17. The inner surface of the stem preferably has an angle at least as large as the angle of the outer surface of the plug to insure adequate static sealing contact therebetween. The outer surface of the plug is suitably sized to define an annular flow passage 28 (FIG. 2) between surfaces 23 and 27 when the plug is moved in its opening direction 25 through a predetermined distance to thus communicate inlet 21 with outlet 22. For example, a maximum outer diameter large $D_1$ on the uppermost end of the plug could be identical (or slightly larger) and aligned radially with an internal diameter of tapered inner wall 23 of the stem when the plug is moved downwardly through a distance "d" to its closed position in FIG. 4.

Thus, when the plug is moved in its closing direction 26 and through distance "d", the outer surface of the plug will compress against the rigid inner wall of the stem to initiate the sealing function. The elastomeric plug may be composed of any suitable natural or synthetic rubber or plastic material that will exhibit sufficient flexibility and softness for this purpose. Such material may have a durometer hardness in the range from thirty to eighty, for example.

The plug has an extension 29 formed centrally thereon to extend upwardly through outlet 22 when the plug is in its upward, open position illustrated in FIG. 2. A plurality of circumferentially spaced stops 30 are formed integrally on an upper end of stem 17 and within passage 20 to extend radially inwardly to define an outlet 22 circumferentially between each adjacent pair of stops. Extension 29 has a reduced diameter forming a slip-fit within the inner surfaces of the stops and defines an annular shoulder 31 on the upper end of plug 24, disposed in axial alignment with the undersides of the stops. Stops 30 and shoulder 31 thus define a stop means for limiting upward movement of the plug in its opening direction 25. An upper surface 32 of extension 29 preferably extends at a sufficient distance above an inner surface 33 of flange 18 (e.g., approximately distance "d") to permit the surfaces to at least substantially align themselves with each other when the plug is moved to its fully closed position shown in FIG. 4.

When it is desired to fill balloon 10 with a helium gas or another appropriate gas or liquid, a suitable inflation apparatus is inserted into inlet 21 of the stem for this purpose. For example, U.S. Pat. No. 4,167,207 discloses an inflation apparatus of this type which will mechanically engage and move plug in its opening direction 25 whereby pressurized helium can be selectively communicated through annular passage 28 and outer 22 and into inflation chamber 15 of the balloon. The filling valve stem (not shown) will engage the underside of plug 24 in FIG. 2 to move shoulder 31 of the plug into engagement with stop 30 to maximize the area of passage 28 for filling purposes.

After the balloon has been filled or at least partially filled, the inflation apparatus is removed from stem 17 and the user need only depress his finger against the outside of panel 14 and over extension 29 of the plug to move the plug in its closing direction 26 in FIG. 4. As described above, the elastomeric plug will thus compress into static sealing relationship against inner wall 23 of the stem to provide a fluid tight seal substantially along the full length of the plug, as shown in FIG. 4. A standard tang 34 may be molded as an integral part of stem 17 for attachment of a string thereto in a conventional manner. Should the balloon become partially deflated, it can be refilled in the above-described manner.

Figure 6:
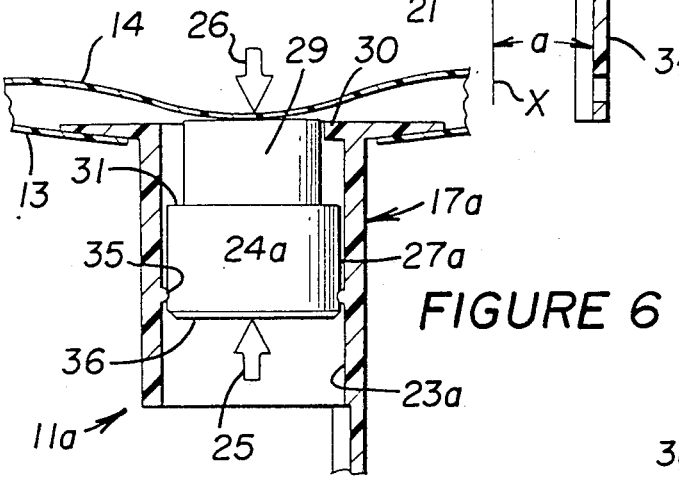

FIGS. 5 and 6 illustrate a second inflation valve embodiment **11*a* wherein identical numerals depict corresponding components and constructions, but with certain numerals appearing in these figures being accompanied by an "a" to depict modified constructions. Valve 11*a* essentially differs from valve 11 in that a modified stem 17*a* has an annular bead 35 formed internally on an inner surface 23*a* thereof. As shown in FIG. 5, the bead preferably has an arcuate cross-section and is disposed downwardly from the lower end of an elastomeric plug 24*a* when the plug is disposed in its illustrated open position communicating inlet 21 with outlet 22, via an annular passage 28*a***.

The lower end of the plug is preferably chamfered at 36 to provide means for precisely centering and guiding the plug when it is moved in its closing and sealing direction 26 to compress side wall portions of the plug against bead 35 for static sealing purposes. In this embodiment of the invention, inner wall **23*a* of stem 17*a* may be disposed at an angle of 0° (parallel) relative to longitudinal axis X of the valve whereas an outer surface 27*a* of the plug is preferably disposed at an angle "a" selected from the approximate range of from 0° to 10°, relative to such axis. The FIGS. 5 and 6 valve is constructed of the same types of materials referenced above and will function similar to valve 11 in that after filling, plug 24*a* can be pinched by finger touch from the outside surface of panel 14 of the balloon to move the plug in its closing direction 26 to compress the plug against bead 35 to form an annular static seal, closing passage 28*a* (FIG. 6**).

Figure 7:
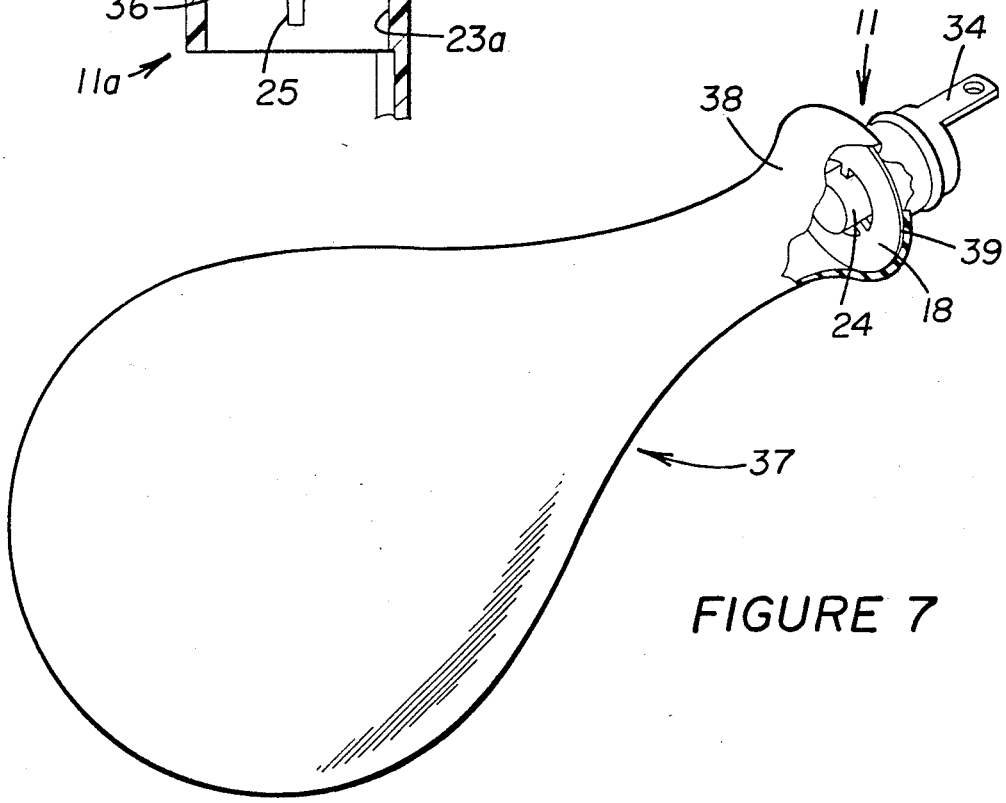
FIG. 7 is a partially sectioned view illustrating attachment of the inflation valve of this invention to the stem of a rubber balloon.

FIG. 7 illustrates the use of either valve 11 or **11*a* with a standard rubber-type balloon 37. In particular, valve 11, for example, is mounted in a conventional manner within a stretched-out stem 38 of the balloon. An outer edge 39 of annular flange 18 will thus form a static seal between the stem of the balloon and the valve. The balloon may be inflated and the valve thereafter closed in the manner described above. Flange 18** is configured and has an outside diameter complying with the "TRAC-TUBE" requirements of the U.S. Product & Safety Commission, i.e., an approximate outside diameter of 1.25 ins.

I claim:

1. A balloon having an inflatable chamber defined therein and an inflation valve of the manual or mechanically operated type for selectively filling said chamber with a fluid, said inflation valve comprising a stem having a rigid inner wall defining a filling passage therethrough communicating with said chamber, said filling passage having an inlet and an outlet, and elastomeric plug means, having an outer surface and a durometer hardness in the range of from thirty to eighty, reciprocally mounted in said passage for movement in a first direction toward said chamber and in a second, opposite direction away from said chamber for (1) openly communicating said passage with said chamber solely through a passageway defined between the outer surface of said plug means and the inner wall of said stem to permit filling of said chamber with said fluid when said plug means is moved to a first predetermined distance in said first direction, and (2) closing said passageway and sealing said passage to prevent escape of said fluid from said chamber when said plug means is moved a second predetermined distance in said second direction to compress the outer surface of said elastomeric plug means against the rigid inner wall of said stem to form an annular static seal therebetween, said plug means being disposed for reciprocal movement along a longitudinal axis of said valve and wherein said passage is defined by an at least generally annular inner wall of said stem that is disposed at an angle within the approximate range of from 0° to 10° relative to said longitudinal axis, when viewed in longitudinal cross-section and in said second direction, and the inner wall of said stem converging at an angle within the approximate range of from 2° to 10° relative to said axis and in said second direction.

2. The balloon of claim 1 wherein said plug means comprises an at least generally cylindrical elastomeric plug and wherein said stem is composed of a semi-rigid plastic material.

3. The balloon of claim 1 further comprising stop means for limiting movement of said plug means in said first direction.

4. The balloon of claim 3 wherein said stop means comprises a plurality of circumferentially spaced stops formed on an inner end of said stem and defining the outlet from said passage communicating with the inflatable chamber of said balloon circumferentially between each adjacent pair of said stops.

5. The balloon of claim 4 wherein said plug means comprises an elastomeric plug having an extension of reduced diameter slip-fitted within said stops and normally extending beyond said stops when said plug means is moved in its first direction to openly communicate said passage with said chamber, said extension defining an annular shoulder on an upper end of said plug disposed in axial alignment with said stops.

6. The balloon of claim 1 wherein said plug means comprises an elastomeric plug having a generally cylindrical outer surface disposed in close proximity to the inner wall of said stem and converging towards said longitudinal axis in said second direction at an angle within the approximate range of from 2° to 10° when viewed in longitudinal crosssection, the angle of the inner wall of said stem being at least as large as the angle of the outer surface of said plug.

7. The balloon of claim 1 further comprising an annular sealing bead secured on an inner surface of said stem, below said plug means when said plug means is moved in its first direction to communicate said passage with said chamber, extending radially inwardly into said passage for engaging and compressing said plug means to form an annular static seal between said stem and said plug means when said plug means is moved through said second predetermined distance in said second direction.

8. The balloon of claim 1 further comprising an annular flange formed integrally on an inner end of said stem adjacent to said outlet and extending radially outwardly therefrom.

9. The balloon of claim 8 wherein said balloon comprises a pair of first and second panels sealed together about the peripheries thereof and wherein said flange is secured to said first panel.

10. The balloon of claim 8 wherein said balloon comprises a rubber-like balloon having a stretchable stem and wherein said stretchable stem is stretched-over said flange to mechanically secure said valve to the stretchable stem of said balloon.

11. An inflation valve of the manual or mechanically operated type comprising a stem having a generally cylindrical rigid inner wall, a filling passage defined by said inner wall through said stem and having inlet means for communicating a pressurized fluid source through said passage and outlet means for passing said fluid thereby, and sealing means, including elastomeric plug means having a generally cylindrical outer surface and reciprocally mounted in said passage for reciprocal movement along a longitudinal axis of said valve in a first direction towards said outlet means and in a second, opposite direction towards said inlet means, for openly communicating said inlet means with said outlet means solely through a passageway defined between the outer surface of said plug means and the inner wall of said stem defining said passage when said plug means is moved a first predetermined distance in its first direction and for closing said passageway and sealing said passage to block communication between said inlet means and said outlet means when said plug means is moved a second predetermined distance in its second direction to compress the outer surface of said elastomeric plug means against the rigid inner wall of said stem to form an annular static seal therebetween, said plug means being composed of an elastomeric material having a durometer hardness within the range of from thirty to eighty, said stem being composed of a plastic material which is relatively rigid compared to that of said plug means, the inner wall of said stem and the outer surface of said plug means each converging in said second direction towards said longitudinal axis and each being disposed at an angle within the approximate range of from 2° to 10° relative to said longitudinal axis, when viewed in longitudinal cross-section, and the angle of the inner wall of said stem being at least as large as the angle of the outer surface of said plug means.

12. The inflation valve of claim 11 further comprising stop means for limiting movement of said plug means in said first direction.

13. The inflation valve of claim 12 wherein said stop means comprises a plurality of circumferentially spaced stops formed on an inner end of said stem and defining the outlet means from said passage circumferentially between each adjacent pair of said stops.

14. The inflation valve of claim 13 wherein said stop means comprises portions of said plug means including an elastomeric plug having an extension of reduced diameter slip-fitted within said stops and normally extending beyond said stops when said plug means is moved in its first direction to openly communicate said inlet means with said outlet means, said extension defining an annular shoulder on an upper end of said plug disposed in axial alignment with said stops.

15. The inflation valve of claim 11 further comprising an annular flange formed integrally on an inner end of said stem adjacent to said outlet means and extending radially outwardly therefrom.

* * * * *